US008934791B2

(12) United States Patent
Eiki

(10) Patent No.: US 8,934,791 B2
(45) Date of Patent: Jan. 13, 2015

(54) FIXING DEVICE AND IMAGE FORMING APPARATUS INCLUDING THE FIXING DEVICE

(71) Applicant: Takashi Eiki, Osaka (JP)

(72) Inventor: Takashi Eiki, Osaka (JP)

(73) Assignee: KYOCERA Document Solutions Inc. (JP)

( * ) Notice: Subject to any disclaimer, the term of this patent is extended or adjusted under 35 U.S.C. 154(b) by 6 days.

(21) Appl. No.: 13/713,330

(22) Filed: Dec. 13, 2012

(65) Prior Publication Data

US 2013/0156447 A1 Jun. 20, 2013

(30) Foreign Application Priority Data

Dec. 14, 2011 (JP) ..... 2011-273179

(51) Int. Cl.
*G03G 15/20* (2006.01)

(52) U.S. Cl.
CPC ..... *G03G 15/2078* (2013.01); *G03G 15/2039* (2013.01); *G03G 15/2053* (2013.01)
USPC ..... 399/33; 399/67; 399/69

(58) Field of Classification Search
None
See application file for complete search history.

(56) References Cited

U.S. PATENT DOCUMENTS

| | | | | |
|---|---|---|---|---|
| 6,037,576 | A * | 3/2000 | Okabayashi et al. | 219/619 |
| 6,930,293 | B2 * | 8/2005 | Matsuo et al. | 219/664 |
| 2010/0320196 | A1 * | 12/2010 | Tabuchi | 219/660 |
| 2011/0223533 | A1 * | 9/2011 | Ishikawa | 430/124.1 |

FOREIGN PATENT DOCUMENTS

| | | |
|---|---|---|
| JP | 2008-197475 | 8/2008 |
| JP | 2009-204745 | 9/2009 |

* cited by examiner

*Primary Examiner* — Clayton E Laballe
*Assistant Examiner* — Ruifeng Pu
(74) *Attorney, Agent, or Firm* — McDonnell Boehnen Hulbert & Berghoff LLP

(57) ABSTRACT

A fixing device includes a heat rotational member that fixes a toner, a pressure rotational member that presses the heat rotational member, a magnetic-flux generation unit, a detector, and a fixing controller. The magnetic-flux generation unit includes a switch unit for switching of power supply to a resonant circuit. The resonant circuit includes a coil that generates a magnetic flux for causing the heat rotational member to generate heat by induction heating, and a capacitor. The detector detects power consumption of the magnetic-flux generation unit. The fixing controller recognizes the power consumption in response to an instruction of target power, sets a switching frequency of the switch unit in accordance with the target power, and causes the switch unit to stop the power supply if a difference between the set switching frequency and the adjusted switching frequency exceeds a predetermined change width.

18 Claims, 9 Drawing Sheets

FIXING DEVICE AND IMAGE FORMING APPARATUS INCLUDING THE FIXING DEVICE

REFERENCE TO RELATED APPLICATION

This application is based upon and claims the benefit of priority from the corresponding Japanese Patent Application No. 2011-273179, filed on Dec. 14, 2011, the entire contents of which are incorporated herein by reference.

BACKGROUND

1. Technical Field

This disclosure relates to a fixing device that fixes toner on a sheet by using induction heating. Also, this disclosure relates to an image forming apparatus including the fixing device that performs induction heating.

2. Description of the Related Art

Some image forming apparatuses, such as a multi-functional peripheral, a copier, a printer, and a facsimile device, perform image formation by using toner. Such an image forming apparatus includes a fixing device that fixes a toner image, which is transferred on a sheet, to the sheet by applying heat and pressure while the sheet is transported in the image forming apparatus. Some fixing devices cause a roller or a belt made of metal to generate heat by induction heating, and then apply the heat to a toner image.

An example of such a fixing device includes: alternating magnetic field generating means for generating an alternating magnetic field; a heating element that generates heat with the alternating magnetic field generated by the alternating magnetic field generating means; detecting means for detecting a value of current or voltage induced in the heating element through which the alternating magnetic field generated by the alternating magnetic field generating means passes; judging means for judging whether or not the heating element is damaged in accordance with the value of current or voltage detected by the detecting means; and protecting means for causing the alternating magnetic field generating means to stop the generation of the alternating magnetic field and protect the fixing device from being further damaged. With this configuration, damage of the heating element is detected to protect the fixing device.

The fixing device of the induction heating system includes a coil. A magnetic flux generated by the coil passes through metal or the like, and hence heat (Joule heat by eddy current) that is applied to a toner image is obtained.

An electric wire (for example, a stranded wire) wound around the coil is covered with an insulating material. However, coatings of adjacent electric wires may be broken and a short circuit may occur between the adjacent electric wires. Such a short circuit is occasionally called "layer short". For example, a layer short may occur if expansion by a temperature increase and contraction by a temperature decrease are repeated and hence the coatings are rubbed with each other. A layer short may also occur if a scratch is made in the coating when the electric wire is wound during manufacturing of the coil or when a mechanical stress is applied to the electric wire and hence the coating is broken.

For induction heating, a resonant circuit is formed by a coil and a capacitor. The frequency of voltage applied to the resonant circuit or the frequency of current flowing through the resonant circuit is adjusted to move towards or away from a resonance frequency. Hence, the output (power) is controlled. If a layer short occurs, the potentials of two adjacent short-circuited electric wires become the same. This represents a substantial decrease in the number of turns of the electric wire wound around the coil. Hence, if a layer short occurs, characteristics of the coil, such as an inductance value, are changed. If the inductance is changed due to a layer short, the resonance frequency of the resonant circuit is changed, and the output by the induction heating can be no longer properly controlled with the control setting for the frequency before the inductance is changed. Therefore, if a layer short occurs, the temperature of a member that is heated by the coil can be no longer properly controlled.

If the fixing device is continuously used even when the inductance is changed due to a layer short, parts and circuits included in the fixing device may be broken. For example, by recognizing power applied to the resonant circuit, the switching frequency is changed so that the difference between the power and target power is eliminated (feedback control). However, if a layer short occurs, even if the feedback control is performed, the difference is not eliminated. The fixing device may be operated to endlessly change the switching frequency. Switching with an abnormal frequency may break the switching element.

The above-described fixing device does not detect a layer short, but rather detects a breakdown of a heated member (a metal belt) that is heated by the coil. As a result, the above-described problems relating to a layer short cannot be addressed. Further, the above-described fixing device needs a sensor such as an antenna, an alternating detecting circuit, a direct detecting circuit, a control circuit, etc., for detecting a breakdown of the heated member (the metal belt). Therefore, the above-described fixing device results in increased manufacturing costs.

SUMMARY

A fixing device according to an aspect of the present disclosure includes a heat rotational member, a pressure rotational member, a magnetic-flux generation unit, a detector for detecting power consumption of the magnetic-flux generation unit and a fixing controller. The heat rotational member contacts a sheet, on which a toner image is transferred, and fixes the toner image to the sheet. The pressure rotational member presses the heat rotational member to form a nip, applies a pressure to the sheet, which passes through the nip, and hence fixes the toner image to the sheet. The magnetic-flux generation unit includes a resonant circuit a switch unit that is connected to the resonant circuit and performs switching of power supply to the resonant circuit. The resonant circuit includes a coil that generates a magnetic flux, which causes the heat rotational member to generate heat by induction heating, and a capacitor. The switch unit is connected to the resonant circuit and performs switching of power supply to the resonant circuit. The detector is used for detecting power consumption of the magnetic-flux generation unit. The fixing controller recognizes the power consumption of the magnetic-flux generation unit based on an output of the detector, in response to an instruction of target power applied to the magnetic-flux generation unit from the outside; sets a switching frequency of the switch unit in accordance with the target power, if current power consumption of the magnetic-flux generation unit is smaller than the target power; adjusts the switching frequency to move towards a reference frequency, which is a resonance frequency of the resonant circuit; and further, causes the switch unit to stop the power supply to the resonant circuit if a difference between the switching frequency set in accordance with the target power and the adjusted switching frequency exceeds a predetermined change width.

An image forming apparatus according to another aspect of the present disclosure includes: a transport unit that transports a sheet; an image forming unit that forms a toner image, which is transferred on the sheet; and a fixing device that fixes the toner image, which is transferred on the sheet, to the sheet. The fixing device includes a heat rotational member, a pressure rotational member, a magnetic-flux generation unit, a detector and a fixing controller. The heat rotational member contacts a sheet, on which a toner image is transferred, and fixes the toner image to the sheet. The pressure rotational member presses the heat rotational member to form a nip, applies a pressure to the sheet, which passes through the nip, and hence fixes the toner image to the sheet. The magnetic-flux generation unit includes a resonant circuit a switch unit that is connected to the resonant circuit and performs switching of power supply to the resonant circuit. The resonant circuit includes a coil that generates a magnetic flux, which causes the heat rotational member to generate heat by induction heating, and a capacitor. The switch unit is connected to the resonant circuit and performs switching of power supply to the resonant circuit. The detector is used for detecting power consumption of the magnetic-flux generation unit. The fixing controller recognizes the power consumption of the magnetic-flux generation unit based on an output of the detector, in response to an instruction of target power applied to the magnetic-flux generation unit from the outside; sets a switching frequency of the switch unit in accordance with the target power, if current power consumption of the magnetic-flux generation unit is smaller than the target power; adjusts the switching frequency to move towards a reference frequency, which is a resonance frequency of the resonant circuit; and further, causes the switch unit to stop the power supply to the resonant circuit if a difference between the switching frequency set in accordance with the target power and the adjusted switching frequency exceeds a predetermined change width.

DETAILED DESCRIPTION OF EMBODIMENTS

An embodiment of the present disclosure is described with reference to FIGS. 1 to 9 with an example of a multi-functional peripheral 100 (corresponding to an image forming apparatus) including a fixing device 1. Respective elements, such as configurations and arrangements, described in embodiments do not limit the scope of the disclosure and are mere examples for explanation.

Brief Configuration of Image Forming Apparatus

Figure 1:
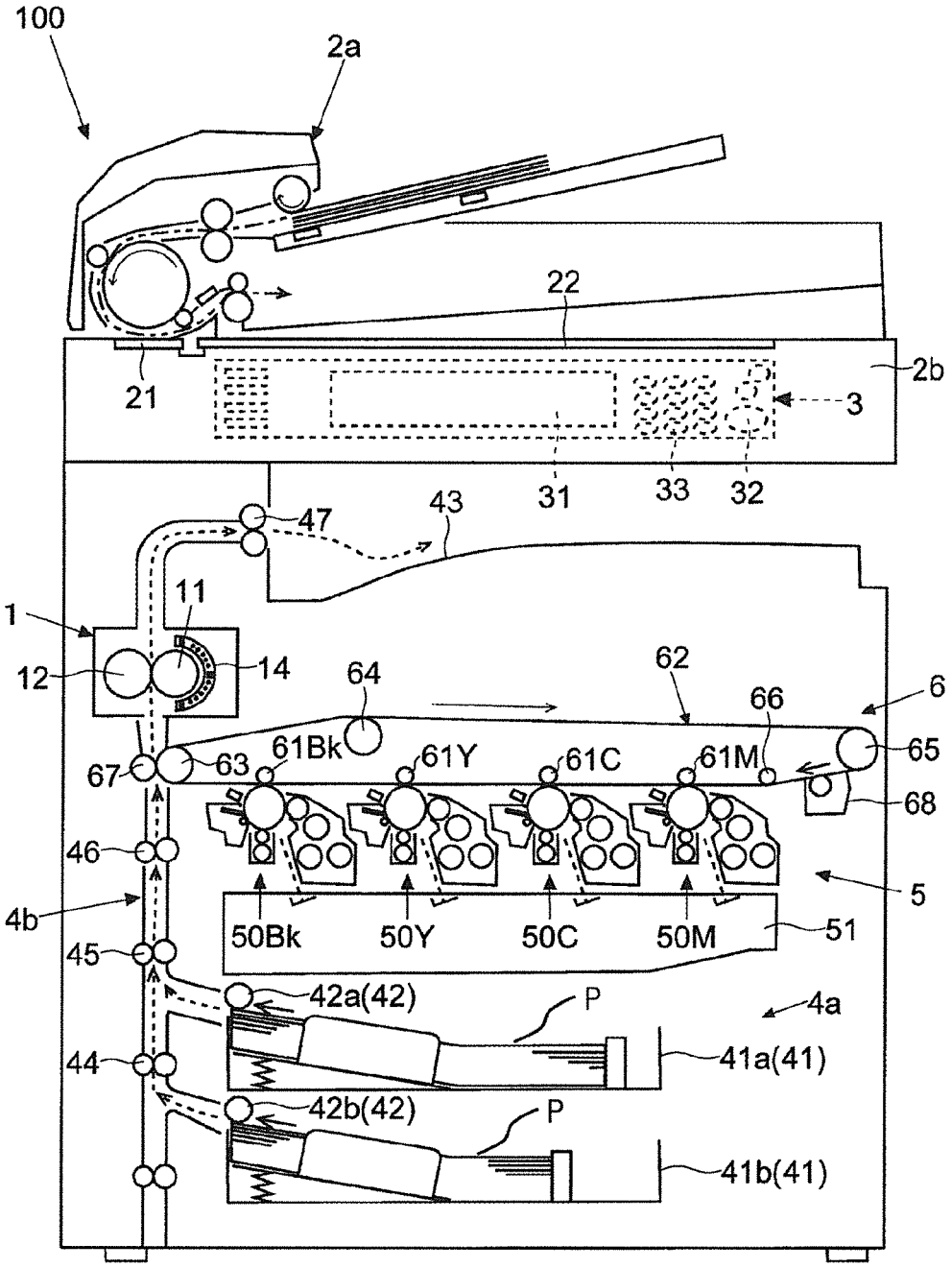
FIG. 1 is a cross-sectional view showing a configuration of a multi-functional peripheral according to an embodiment of the present disclosure.
Figure 2:
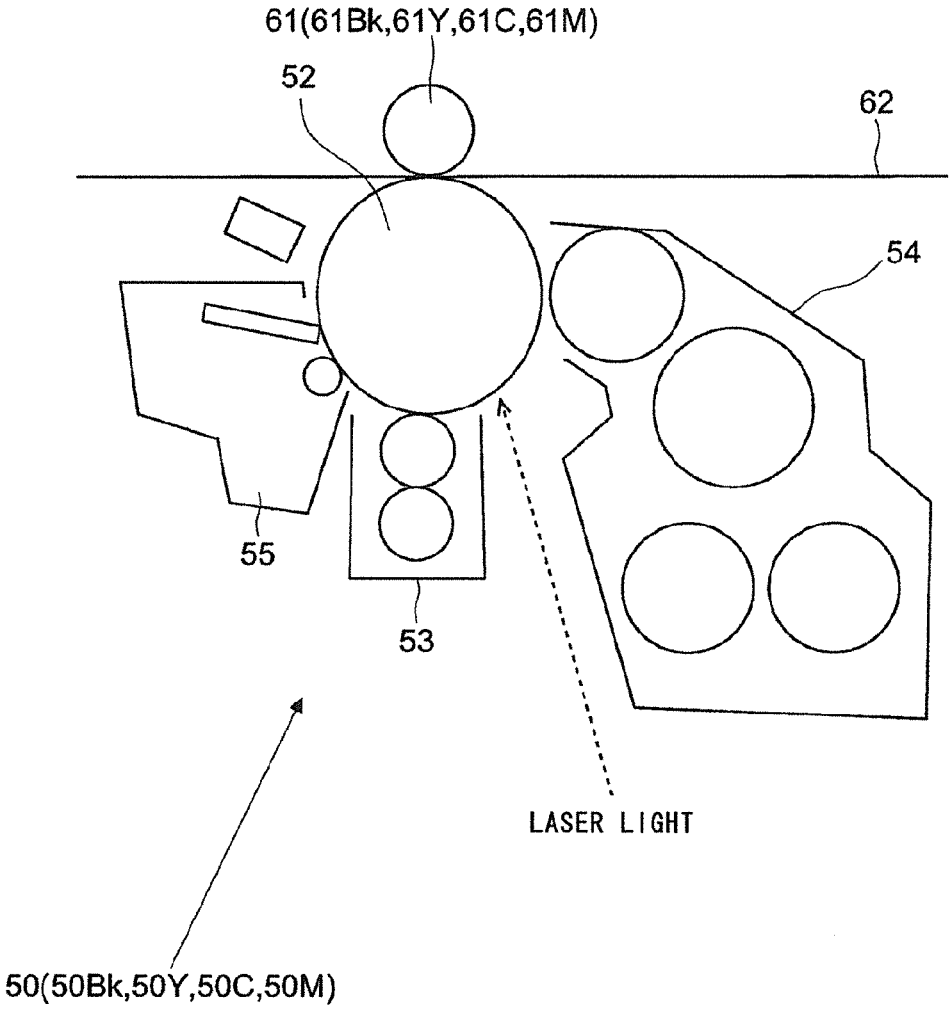
FIG. 2 is a cross-sectional view of an image forming unit according to an embodiment of the present disclosure.

The multi-functional peripheral 100 is described first with reference to FIGS. 1 and 2. FIG. 1 is a cross-sectional view showing a configuration of the multi-functional peripheral 100 while FIG. 2 is a cross-sectional view of an image forming unit 50.

A document transport device 2*a* is provided on the top of the multi-functional peripheral 100. The document transport device 2*a* automatically continuously transports documents to a reading position one by one during copying. An image reading unit 2*b* is provided below the document transport device 2*a*. The document transport device 2*a* is attached to the image reading unit 2*b* and can be opened against the image reading unit 2*b* around the rear end of image reading unit 2*b*, in a direction which corresponds to the width of the document. Hence, the document transport device 2*a* functions as a cover that applies pressure on a contact glass (a feed reading contact glass 21 and a set reading contact glass 22) from the upper side.

The image reading unit 2*b* includes the feed reading contact glass 21 and the set reading contact glass 22 on an upper surface thereof. A document is set on the set reading contact glass 22 when documents, such as pages of a book, are read one by one. In addition, a lamp, a mirror, a lens, an image sensor, etc. (not shown), are arranged in the image reading unit 2*b*. The image sensor reads a document based on reflection light of a document that passes over the feed reading contact glass 21 or a document set on the set reading contact glass 22. The image sensor converts the reflection light into an analog electric signal corresponding to an image density, then quantizes the electric signal, and obtains image data.

Also, an operation panel 3 (corresponding to a notification unit) is provided on a front surface of an upper section of the multi-functional peripheral 100 as indicated by broken lines in FIG. 1. The operation panel 3 includes keys for setting the multi-functional peripheral 100 and for giving operation instructions to the multi-functional peripheral 100, and a liquid crystal display unit 31 that displays a state of the multi-functional peripheral 100. The liquid crystal display unit 31 is a touch panel. A user presses a key displayed on the liquid crystal display unit 31 and hence sets the multi-functional peripheral 100 and gives an operation instruction to the multi-functional peripheral 100. For example, the user can designate the size and kind of sheets P to be used with the operation panel 3. Also, the operation panel 3 includes a plurality of hard keys, such as a start key 32 for instructing execution of copying, etc. and a numeric keypad 33 for input of numerical values, for example, number of copies, after a setting is made.

Also, the multi-functional peripheral 100 includes therein a sheet feed unit 4*a*, a transport unit 4*b*, an image forming unit 5, an intermediate transfer unit 6, and the fixing device 1, in that order from the upstream side in a transport direction of a sheet P.

The sheet feed unit 4*a* includes cassettes 41, each accommodating a plurality of sheets P of one of various kinds (for example, normal paper such as copy paper, recycled paper, thin paper, thick paper, OHP sheets, etc.) and one of various sizes (for example, standard sizes, such as A4, A5, B4, letter size, etc.) used for printing. In FIG. 1, reference numeral 41*a* is applied to an upper cassette and reference numeral 41*b* is applied to a lower cassette. Also, sheet feed rollers 42 rotationally driven by a sheet feed motor (not shown) are provided for the respective cassettes 41. In FIG. 1, reference numeral 42*a* is applied to an upper roller and reference numeral 42*b* is applied to a lower roller. During printing, one of the sheet feed rollers 42 feeds sheets P to the transport unit 4*b* one by one.

Then the transport unit 4*b* transports a sheet P and guides the sheet P from the sheet feed unit 4*a* to an output tray 43 through the intermediate transfer unit 6 and the fixing device 1. The transport unit 4*b* includes a plurality of transport-roller pairs 44 and 45, a guide plate (not shown) that guides transport of the sheet P, and a registration-roller pair 46. The registration-roller pair 46 stops the transported sheet P at a position before the intermediate transfer unit 6, and feeds the sheet P at a timing corresponding to a transfer timing of a toner image. Also, an output-roller pair 47 is provided at the downstream side of the fixing device 1 in the transport direction of the sheet P. The output-roller pair 47 outputs the sheet P to the output tray 43.

As shown in FIGS. 1 and 2, the multi-functional peripheral 100 includes the image forming unit 5 that forms a toner image in accordance with image data. Specifically, the image forming unit 5 includes four-color image forming units including an image forming unit 50Bk that forms a black image, an image forming unit 50Y that forms an yellow image, an image forming unit 50C that forms a cyan image, an image forming unit 50M that forms a magenta image, and an exposure device 51.

Now the image forming units 50Bk to 50M are described in detail with reference to FIGS. 1 and 2. The image forming units 50Bk to 50M have basically similar configurations except that the colors of toner images to be formed are different. In the following description, while the image forming unit 50Bk is described as an example, the portions Bk, Y, C, and M of the reference numerals are omitted unless otherwise particularly described.

A photoconductor drum 52 is rotatably supported, receives a driving force from a motor (not shown) to rotate, and can hold a toner image on the peripheral surface thereof. The photoconductor drum 52 is rotationally driven counterclockwise with respect to the paper face of FIG. 2 at a predetermined speed. A charging device 53 charges the photoconductor drum 52 with electricity at a constant potential by a roller. The charging device 53 may charge the photoconductor drum 52 with electricity by a corona discharge system or by using a brush or the like.

The exposure device 51 below the image forming unit 50 radiates the photoconductor drum 52 with laser light (indicated by broken lines) which is an optical signal, in accordance with an image signal after color separation. The exposure device 51 exposes the photoconductor drum 52 with light by scanning the photoconductor drum 52 after the charging, and forms an electrostatic latent image on the surface of the photoconductor drum 52. A developing device 54 houses a developer containing toner (a developing device for the image forming unit 50Bk houses a black developer, a developing device for the image forming unit 50Y houses a yellow developer, a developing device for the image forming unit 50C houses a cyan developer, and a developing device for the image forming unit 50M houses a magenta toner). The developing device 54 supplies the photoconductor drum 52 with the toner. As a result, the electrostatic latent image formed on the surface of the photoconductor drum 52 is developed as a toner image. A cleaning device 55 scrapes and removes any contamination, such as the toner remaining on the surface of the photoconductor drum 52, after the transfer.

Referring back to FIG. 1, the intermediate transfer unit 6 receives the primary transfer of the toner image from each photoconductor drum 52, and performs the secondary transfer on a sheet P. The intermediate transfer unit 6 includes primary transfer rollers 61Bk to 61M, an intermediate transfer belt 62, a driving roller 63, driven rollers 64 to 66, a secondary transfer roller 67, and a belt cleaning device 68. Each of the primary transfer rollers 61Bk to 61M and the respective photoconductor drums 52 corresponding to the primary transfer rollers 61Bk to 61M pinch the intermediate transfer belt 62 therebetween.

The intermediate transfer belt 62 is made of dielectric resin or the like. The intermediate transfer belt 62 is wound around the driving roller 63, the driven rollers 64 to 66, and the primary transfer rollers 61Bk to 61M with a tension. When the driving roller 63 connected to a driving mechanism (not shown), such as a motor, is rotationally driven, the intermediate transfer belt 62 rotates clockwise with respect to the paper face in FIG. 1. The driving roller 63 and the secondary transfer roller 67 pinch the intermediate transfer belt 62 therebetween. The driving roller 63 and the secondary transfer roller 67 form a secondary transfer nip.

The transfer of a toner image is described as follows. First, a predetermined primary transfer bias is applied to each of the primary transfer rollers 61Bk to 61M. The respective toner images (the respective colors of black, yellow, cyan, and magenta) formed by the image forming units 50 are primarily-transferred on the intermediate transfer belt 62 while the toner images are successively superposed without a deviation. Then the registration-roller pair 46 feeds a sheet P to the secondary transfer nip at a time corresponding to the entry of the superposed toner images of the respective colors to the secondary transfer nip. Also, a secondary transfer bias is applied to the secondary transfer roller 67. Hence, the toner images are secondarily-transferred on the sheet P. The belt cleaning device 68 removes and collects the remaining toner on the intermediate transfer belt 62 after the secondary transfer.

The fixing device 1 is arranged at the downstream side of the intermediate transfer unit 6 in the transport direction of the sheet P. The fixing device 1 applies heat and pressure to the toner images secondarily-transferred on the sheet P and hence fixes the toner images to the sheet P. The sheet P after the fixing is output to the output tray 43. Thus, image forming processing is completed. The details of the fixing device 1 are described later.

Hardware Configuration of Multi-Functional Peripheral 100

Figure 3:
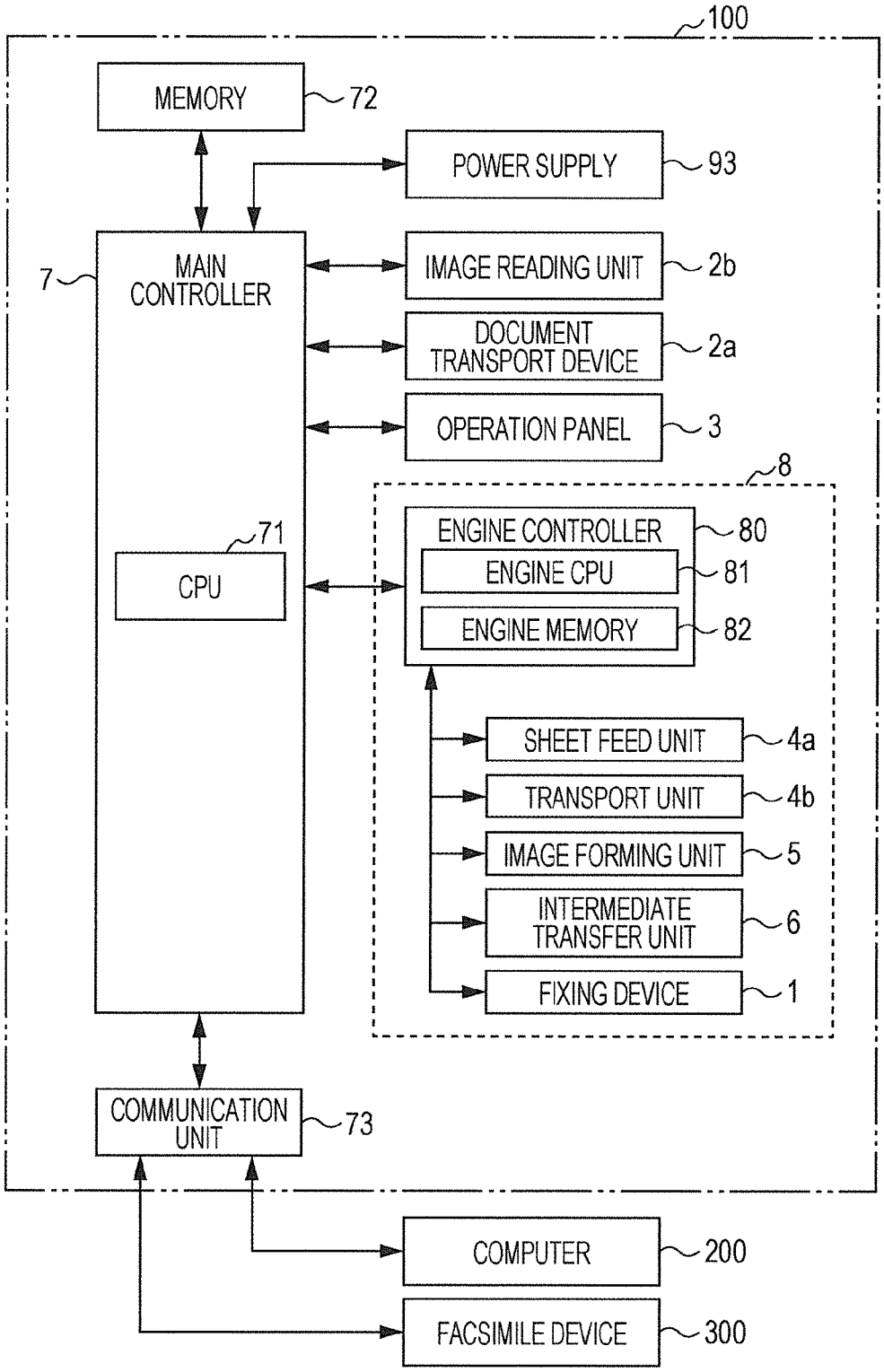
FIG. 3 is a block diagram showing a hardware configuration of the multi-functional peripheral.

Next, a hardware configuration of the multi-functional peripheral 100 according to the present embodiment is described with reference to FIG. 3. FIG. 3 is a block diagram showing the hardware configuration of the multi-functional peripheral 100.

As shown in FIG. 3, the multi-functional peripheral 100 according to the present embodiment includes a main controller 7 therein. The main controller 7 controls respective sections of the machine. For example, the main controller 7 includes a CPU 71 and other electronic circuits and elements. Also, the main controller 7 is connected to a memory 72. The CPU 71 is a central processing unit, and performs control of the respective sections in the multi-functional peripheral 100 and arithmetic operation based on control programs that are stored in the memory 72 and extracted. The memory 72 is configured by combination of volatile and non-volatile memory devices, such as a ROM, a RAM, a flash ROM, and a HDD. For example, the memory 72 stores various data such as control data in addition to the control programs of the multi-functional peripheral 100.

The main controller 7 is connected to an engine controller 80 (corresponding to a controller) that controls an engine unit 8 (the sheet feed unit 4*a*, the transport unit 4*b*, the image forming unit 5, the intermediate transfer unit 6, and the fixing device 1) that performs image formation and printing. The main controller 7 gives an instruction to the engine controller 80 so that image formation is properly performed on the basis of the control programs and data in the memory 72.

The engine controller 80 includes an engine CPU 81 that performs arithmetic operation and processing based on instructions given from the main controller 7 and data and programs stored in an engine memory 82. The engine controller 80 includes the engine memory 82. The engine memory 82 includes a ROM and a RAM, and stores programs and data for controlling operation (printing operation) of the engine unit 8.

The main controller 7 is also connected to a communication unit 73. The communication unit 73 is an interface for communicating with a computer 200 (a personal computer or a server) or a facsimile device 300. The communication unit 73 communicates with the computer 200 or the facsimile device 300 through a network or a cable.

For example, the multi-functional peripheral 100 can receive data relating to image data and print settings from the computer 200 through the communication unit 73 and can perform printing (a printer function). Also, the multi-functional peripheral 100 can transmit image data based on data obtained to the computer 200 through the communication unit 73 (a scanner function). Data may be obtained, for example, from the image reading unit 2*b* reading a document. Also, the multi-functional peripheral 100 can receive and transmit image data from and to the facsimile device 300 through the communication unit 73, and the multi-functional peripheral 100 can perform printing based on the data received from the facsimile device 300 (a facsimile function).

Further, the main controller 7 is connected to the image reading unit 2*b* and the document transport device 2*a* so that communication can be made therebetween. The main controller 7 controls operations of the image reading unit 2*b* and operations of the document transport device 2*a*. Also, the main controller 7 is connected to the operation panel 3 so that communication can be made therebetween. The main controller 7 also controls operations of the operation panel 3, such as the display of the operation panel 3. The main controller 7 recognizes setting content made with the operation panel 3, and recognizes an execution instruction of a job. The main controller 7 is connected to a power supply 93.

Configuration of Fixing Device 1

Figure 4:
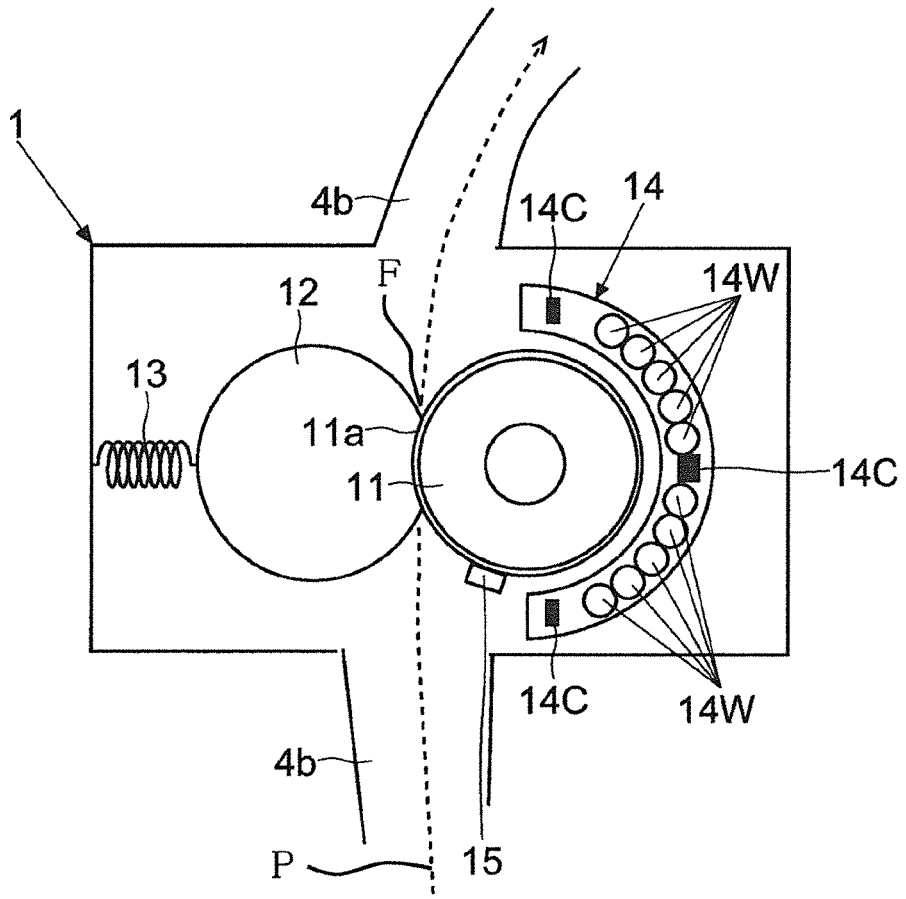
FIG. 4 is a cross-sectional view of a fixing device according to an embodiment of the present disclosure when viewed from the front.

Next the fixing device 1 according to the present embodiment is described with reference to FIG. 4. FIG. 4 is a cross-sectional view of the fixing device 1 when viewed from the front.

As shown in FIG. 4, the fixing device 1 according to the present embodiment includes therein a heat roller 11 (corresponding to a heat rotational member), a pressure roller 12 (corresponding to a pressure rotational member), an urging member 13, a coil 14, and a temperature sensor 15 (corresponding to a temperature detector). The heat roller 11 and the pressure roller 12 are rotatably supported such that the axes of the rollers are parallel to each other.

First, the axis of the heat roller 11 is along the depth direction of paper face in FIG. 4 (which is the direction perpendicular to the transport direction of the sheet P, or the width direction of the sheet P). The heat roller 11 generates heat by induction heating with a magnetic flux from the coil 14 for fixing. For example, the heat roller 11 is formed by winding a belt (a heat belt 11*a*) made of metal such as nickel on the surface of a metal cylindrical tube (the inside of the tube may be filled).

The pressure roller 12 faces the heat roller 11. The material of the peripheral surface of the pressure roller 12 has elasticity (for example, silicone rubber). The pressure roller 12 presses the heat roller 11. Specifically, the urging member 13 urges the pressure roller 12 in a direction in which the pressure roller 12 presses the heat roller 11. For example, the urging member 13 is a spring (or may be a member other than the spring). The pressure roller 12 presses the heat roller 11 such that a fixing nip F is formed.

A driving force of a fixing motor 16 (see FIG. 5) provided in the fixing device 1 is transmitted to the pressure roller 12. Hence, the pressure roller 12 rotates. When the pressure roller 12 rotates, the heat roller 11 is rotated. While the heat roller 11 is rotated and when the sheet P with the toner images transferred thereon enters the fixing nip F, is transported, and passes through the fixing nip F, the toner images transferred on the sheet P are heated and pressed, and are fixed to the sheet P. The transport direction of the sheet P is indicated by a broken line in FIG. 4.

Next the coil 14 is described. As shown in FIG. 4, the coil 14 faces the peripheral surface of the heat roller 11 on a side opposite to the side provided with the pressure roller 12. The coil 14 is formed by winding an electric wire 14W along the axial direction of the heat roller 11 so that the shape of the coil 14 has a truncated chevron shape when the heat roller 11 is viewed in the circumferential direction.

The coil 14 is formed by winding the single stranded electric wire 14W a plurality of times (for example, by 10 turns). The surface of the electric wire 14W is coated with an insulating material (for example, enamel). Both ends of the electric wire 14W serve as terminals. When voltage is applied to the terminals, current flows through the coil 14, and a magnetic flux is generated. The magnetic flux generated by the coil 14 links a heat belt 11*a* of the heat roller 11. Hence, the heat belt 11*a* is heated with Joule heat by eddy current (induction heating). The heat roller 11 is then rotated to shift the heated position of the heat belt 11*a*. Since the heat roller 11 is rotated, the heat is transferred to the pressure roller 12, which in turn is heated. Since rapid heating can be provided, the heat roller 11 generates heat only during image formation. When image formation is not performed, such as when printing has ended or in a power save mode, the heat roller 11 does not generate heat.

The coil 14 includes three ferrite cores 14C therein. As shown in FIG. 4, the ferrite cores 14C are provided at the center and at both end positions of the wound wires of the coil 14 when viewed in the axial direction so that the ferrite cores 14C extend along the peripheral surface of the heat roller 11. The ferrite cores 14C prevent the magnetic flux generated by the coil 14 from being diffused, and cause the magnetic flux to efficiently link the heat belt 11*a*.

Also the temperature sensor 15 (corresponding to a temperature detector) is provided in the fixing device 1 according to the present embodiment. The temperature sensor 15 is provided near an entry area of the sheet P to the fixing device 1 and is in contact with the heat roller 11. The temperature sensor 15 may be a non-contact type. Alternatively, the temperature sensor 15 may be provided near an exit area of the sheet P from the fixing device 1. The temperature sensor 15 includes, for example, a thermistor. The output voltage of the temperature sensor 15 is changed depending on the temperature of the heat roller 11 (the heat belt 11*a*). Alternatively, a plurality of the temperature sensors 15 may be provided to detect the temperatures at a plurality of positions along the axial direction of the heat roller 11.

Hardware Configuration of Fixing Device 1

Figure 5:
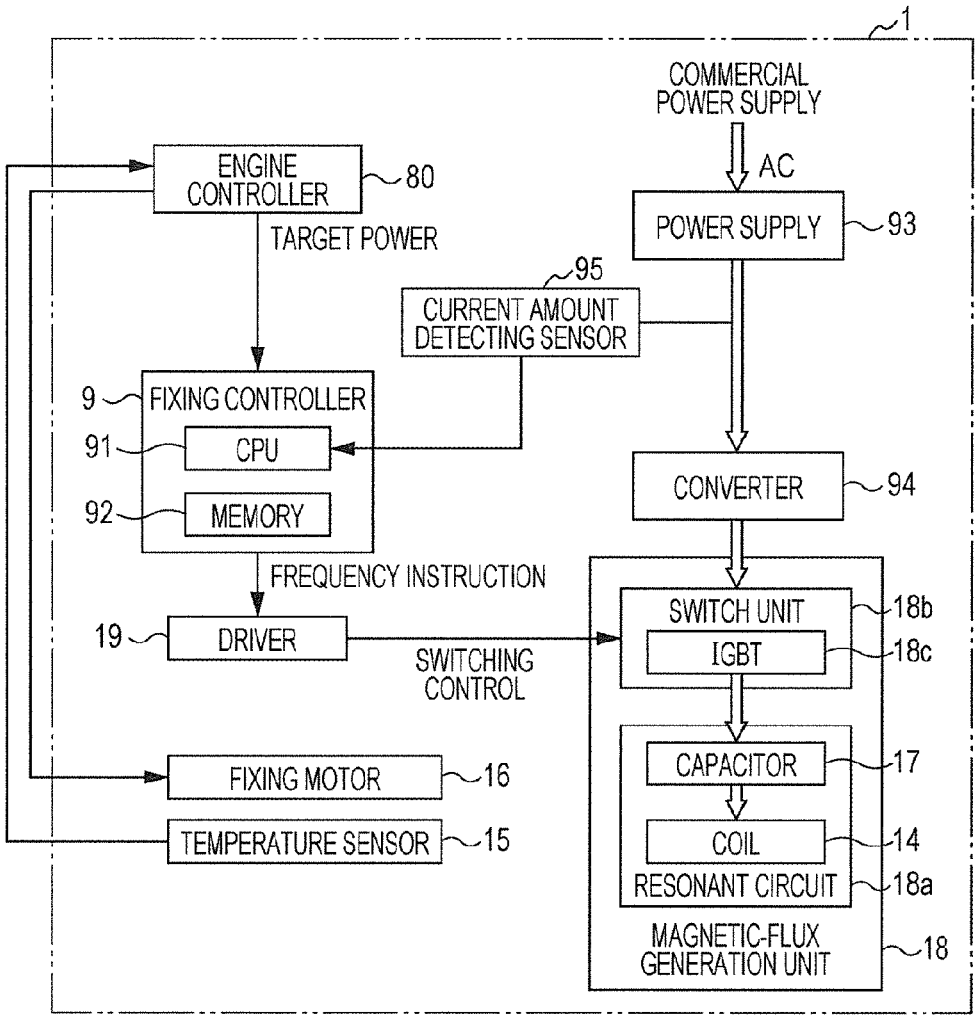
FIG. 5 is a block diagram explaining a hardware configuration of the fixing device.

Next a hardware configuration of the fixing device 1 according to the present embodiment is described with reference to FIG. 5. FIG. 5 is a block diagram explaining the hardware configuration of the fixing device 1.

As shown in FIG. 5, the fixing device 1 according to the present embodiment includes a fixing controller 9 that controls the heating of the fixing device 1. The fixing controller 9 performs heating control in response to an instruction of target power of the fixing device 1 received from the engine controller 80. The fixing controller 9 includes a CPU 91 and a memory 92 that stores data and programs relating to the heating control. For example, the CPU 91 in the fixing controller 9 performs temperature control of the heat roller 11 by induction heating.

The fixing device 1 includes the fixing motor 16 that rotationally drives the heat roller 11 and the pressure roller 12. The engine controller 80 rotates the fixing motor 16, for example, when the heat roller 11 generates heat by induction heating.

As shown in FIG. 5, a capacitor 17 is connected to the coil 14 in the fixing device 1. The coil 14 and the capacitor 17 form a resonant circuit 18*a*. In other words, the fixing device 1 includes the resonant circuit 18*a*. The fixing device 1 also includes therein a switch unit 18*b* that turns ON and OFF the supply of power to the resonant circuit 18*a*. The switch unit 18*b* includes a switching element that is an insulated gate bipolar transistor ("IGBT") 18*c*. The switch unit 18*b* and the resonant circuit 18*a* form a magnetic-flux generation unit 18 that generates a magnetic flux to cause the heat roller 11 (the heat belt 11*a*) to generate heat (an induction heating unit that generates a magnetic flux for heating the heat roller 11 by induction heating). A converter 94 is disposed between the magnetic-flux generation unit 18 and the power supply 93. The converter 94 is a circuit that rectifies alternating voltage, smooths the alternating voltage, and generates direct voltage.

The fixing device 1 includes therein a driver 19 that controls switching (a switching frequency) of the switch unit 18*b*. The driver 19 turns ON and OFF the switch unit 18*b* with a switching frequency corresponding to a frequency instruction of the fixing controller 9.

An example of a power supply system for the magnetic-flux generation unit 18 is now described with reference to FIG. 5. First, a commercial power supply is connected to the power supply 93 of the multi-functional peripheral 100 (the fixing device 1). Alternating power supplied from the commercial power supply is input to the converter 94 through the power supply 93 (AC input).

The converter 94 is connected to the switch unit 18*b*. If the switch unit 18*b* is turned ON, the power is supplied from the converter 94 to the resonant circuit 18*a*. In contrast, if the switch unit 18*b* is turned OFF, the power supply from the converter 94 to the resonant circuit 18*a* is stopped.

Basic Flow of Heating by Fixing Device 1

Next a basic flow when the heat roller 11 of the fixing device 1 generates heat by induction heating is described with reference to FIG. 5.

The fixing device 1 according to the present embodiment includes the temperature sensor 15. The output (voltage) of the temperature sensor 15 is input to the engine controller 80. The engine controller 80 references data of a temperature corresponding to the output voltage of the temperature sensor 15 stored in the engine memory 82. Accordingly, the engine controller 80 recognizes the temperature of the heat roller 11 (the heat belt 11*a*).

The engine controller 80 transmits data indicative of target power to be output by the switch unit 18*b* of the magnetic-flux generation unit 18 to the resonant circuit 18*a* to the fixing controller 9 in accordance with the recognized temperature. The engine controller 80 performs the temperature recognition and the transmission of the data indicative of the target power at a constant period (for example, a period of several tens of milliseconds). The engine controller 80 controls the operation of the fixing controller 9 based on the output of the temperature sensor 15. Hence, the engine controller 80 functions as part of the fixing device 1.

The engine controller 80 gives larger target power to the fixing controller 9 as the temperature of the heat roller 11 is lower. Also, the engine controller 80 gives smaller target power to the fixing controller 9 as the temperature of the heat roller 11 is closer to a fixing control temperature (for example, about 170° C.). Further, if the temperature of the heat roller 11 exceeds the fixing control temperature, the engine controller 80 gives an instruction of the target power being zero to the fixing controller 9.

The engine memory 82 (see FIG. 3) stores data in which target power is determined with respect to a temperature of the heat roller 11. The engine controller 80 references data in which target power is determined with respect to a temperature of the heat roller 11, and transmits data indicative of target power to the fixing controller 9.

The fixing controller 9 applies power to the magnetic-flux generation unit 18 to achieve target power (power consumption) instructed by the engine controller 80. In the fixing device 1 according to the present embodiment, the magnetic-flux generation unit 18 includes the resonant circuit 18*a*. Hence, as the switching frequency of the switch unit 18*b* is closer to the resonance frequency of the resonant circuit 18*a*, larger current flows in the magnetic-flux generation unit 18 and larger power is applied. Hence, for the heating control, the resonance frequency is set as a reference switching frequency (a reference frequency).

Owing to this, as the target power becomes larger, the fixing controller 9 causes the driver 19 to perform the switching of the switch unit 18*b* so that the switching frequency of the switch unit 18*b* moves closer to the resonance frequency (the reference frequency). In contrast, as the target power becomes smaller, the fixing controller 9 causes the driver 19 to perform the switching of the switch unit 18*b* so that the switching frequency of the switch unit 18*b* moves farther from the resonance frequency (the reference frequency). Also, if the target power is zero, the fixing controller 9 causes the driver 19 to turn OFF the switch unit 18*b*.

The memory 92 of the fixing controller 9 stores data in which a switching frequency is determined with respect to target power. When the fixing controller 9 receives data indicative of target power from the engine controller 80, the fixing controller 9 references data in which a switching frequency is determined with respect to target power in the memory 92. Then the fixing controller 9 gives the switching frequency to the driver 19 (or transmits data indicative of the switching frequency).

When the fixing controller 9 receives the data indicative of the target power from the engine controller 80, the fixing controller 9 gives the driver 19 the switching frequency, based on the data in the memory 92. However, the output to the magnetic-flux generation unit 18 (the power consumption of the magnetic-flux generation unit 18) may be shifted from the target power due to an error or the like.

Hence, the fixing controller 9 performs feedback control so that the power consumption of the magnetic-flux generation unit 18 meets the target power. More specifically, the fixing device 1 includes a current amount detecting sensor 95 (corresponding to a detector). The output of the current amount detecting sensor 95 is input to the fixing controller 9. The current amount detecting sensor 95 outputs voltage corresponding to the magnitude of input current to the converter 94. The fixing controller 9 recognizes the magnitude of the input current to the converter 94 based on the magnitude of the output voltage of the current amount detecting sensor 95. The memory 92 of the fixing controller 9 stores data indicative of an input current value to the converter 94 corresponding to an output voltage value of the current amount detecting sensor 95. The fixing controller 9 references the output voltage value of the current amount detecting sensor 95 and the data, and recognizes the magnitude of the input current to the converter 94.

In the present embodiment, the power of the commercial power supply is also input to the converter 94 through the power supply 93. The fixing controller 9 may obtain the magnitude of the power to be applied to the magnetic-flux generation unit 18 by multiplying the square of input current (I) by a resistance value of the magnetic-flux generation unit 18. Alternatively, since the commercial power supply provides AC 100V (an effective value is 100V), the fixing controller 9 may obtain the magnitude of the power to be applied to the magnetic-flux generation unit 18 (the power consumption of the magnetic-flux generation unit 18) based on the obtained input current (I)×100 (V). Since the converter 94 consumes constant power, the fixing controller 9 may determine a value obtained by subtracting the power consumed by the converter 94 from the value of the input current (I)×100 (V), as power to be applied to the magnetic-flux generation unit 18.

If a difference is present between the target power and the recognized power consumption of the magnetic-flux generation unit 18, the fixing controller 9 adjusts the switching frequency to eliminate the difference. If the power consumption of the magnetic-flux generation unit 18 is smaller than the target power (if the power consumption does not reach the target power), the driver 19 makes the switching frequency move closer to the resonance frequency (the reference frequency). Also, if the power consumption of the magnetic-flux generation unit 18 is larger than the target power, the driver 19 makes the switching frequency move farther from the resonance frequency (the reference frequency).

The memory 92 of the fixing controller 9 stores data indicative of an amount by which the switching frequency is changed in accordance with the magnitude of the difference between the target power and the recognized power consumption of the magnetic-flux generation unit 18 (or data indicative of an adjusted amount of the switching frequency). Then the fixing controller 9 determines the switching frequency after the adjustment (an adjusted switching frequency) in accordance with the magnitude of the difference between the target power and the recognized power consumption of the magnetic-flux generation unit 18, based on the data stored in the memory 92. The fixing controller 9 transmits the adjusted switching frequency to the driver 19. As described above, the fixing controller 9 adjusts the switching frequency of the switch unit 18*b* so that the recognized power consumption of the magnetic-flux generation unit 18 meets the target power.

Frequency Characteristics

Figure 6:
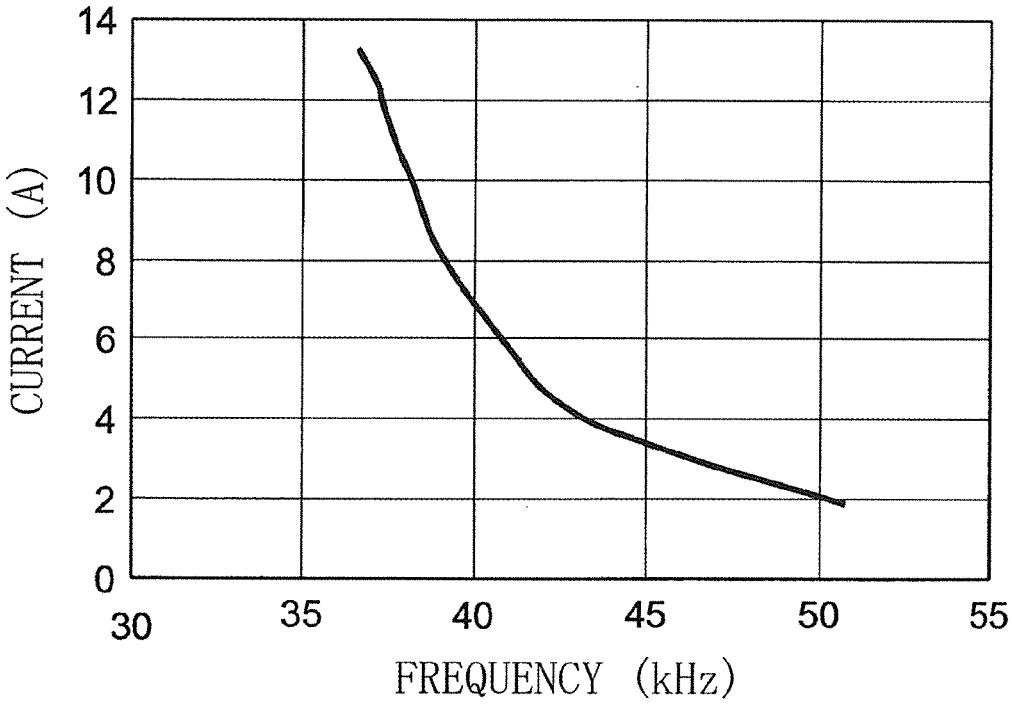
FIG. 6 is a graph showing the magnitude of current with respect to frequency.
Figure 7:
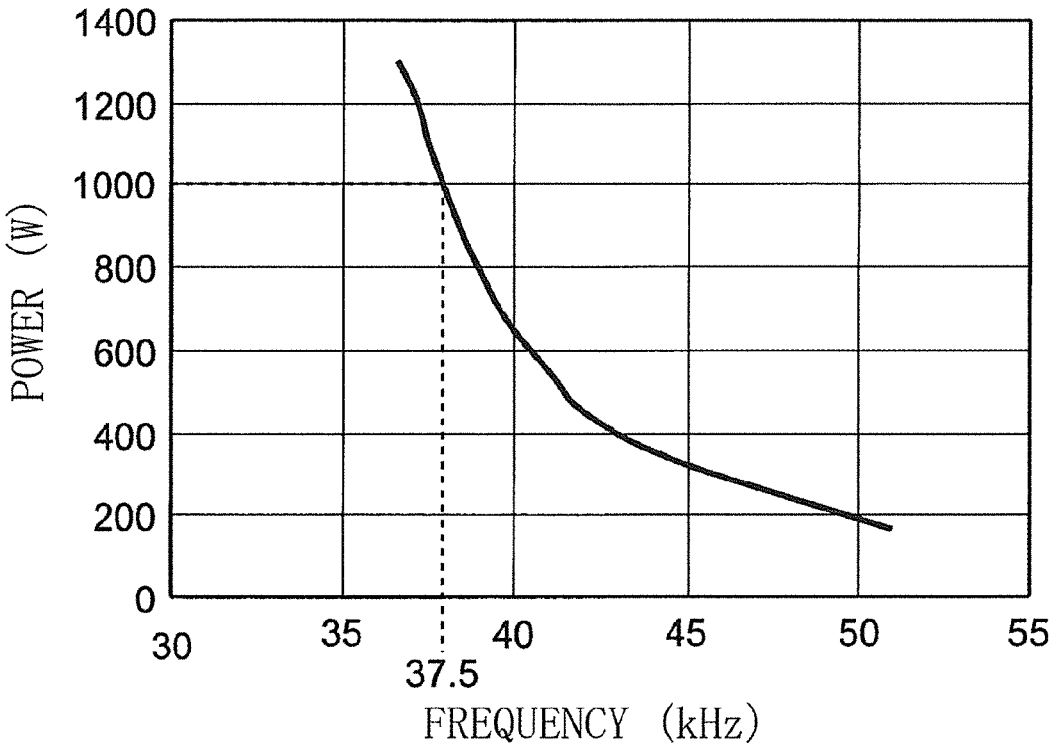
FIG. 7 is a graph showing the magnitude of power with respect to frequency.

Next frequency characteristics of the fixing device 1 according to the present embodiment are described with reference to FIGS. 6 and 7. FIG. 6 is a graph showing the magnitude of current with respect to frequency. FIG. 7 is a graph showing the magnitude of power with respect to frequency.

The resonance frequency can be typically obtained by Expression (1) as follows:

$$f(\mathrm{Hz}) = \frac{1}{2\pi\sqrt{LC}}, \tag{1}$$

where f is a resonance frequency, L is an inductance, and C is a capacitance.

It is assumed that the fixing device 1 according to the present embodiment has a resonance frequency (a reference frequency that is a frequency serving as a reference for power consumption control of the magnetic-flux generation unit 18) of about 35 kHz. The following description is based on this assumption. The resonance frequency depends on the coil 14, the capacitor 17, and the system configuration of the fixing device 1. The resonance frequency of the fixing device 1 is not limited to about 35 kHz. For induction heating, for example, a frequency in a range from 20 to 100 kHz may be used as the resonance frequency (the reference frequency).

At this time (when the reference frequency is about 35 kHz), for example, the coil 14 of the present embodiment has an inductance of 27 μH, and the capacitor 17 has a capacitance of 0.77 μF. FIG. 6 shows the relationship between the frequency and the current in such a resonant circuit 18*a*. FIG. 7 shows the relationship between the frequency and the power. As shown in FIG. 7, if the target power is 1000 W, the fixing controller 9 causes the driver 19 to perform the switching with a switching frequency of about 37.5 kHz.

In the fixing device 1 according to the present embodiment, the fixing controller 9 causes the driver 19 to perform the switching with a frequency higher than the resonance frequency. This is because, if switching is performed with a frequency lower than the resonance frequency, even if current attempts to flow through the IGBT 18*c* of the switch unit 18*b* in a certain direction, the current may flow in an opposite direction. In this instance, the IGBT 18*c* may be broken.

Change in Resonance Frequency due to Layer Short

Figure 8:
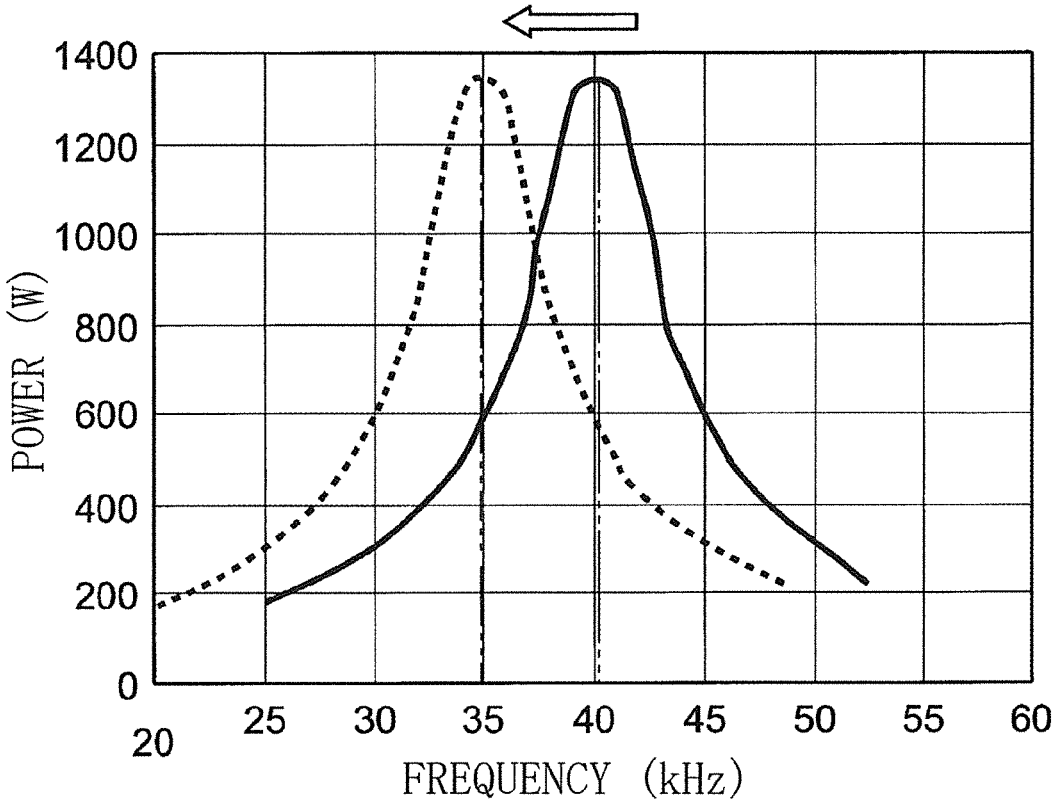
FIG. 8 is a graph showing a change in resonance frequency.

Next a change in resonance frequency due to a layer short is described with reference to FIG. 8. FIG. 8 is a graph showing a change in resonance frequency.

The coil 14 uses the electric wire 14W coated with the insulating material. As the fixing device 1 is used, the coatings of the adjacent electric wires 14W may be broken, and a layer short may occur, in which a short circuit occurs between the adjacent electric wires 14W.

For example, the temperature of the fixing device 1 is entirely increased because of generation of heat by the heat roller 11. With the increase in temperature, the coil 14 expands. Also, the coil 14 contracts, for example, if the power supply to the magnetic-flux generation unit 18 is stopped and the temperature of the fixing device 1 is decreased because the main power supply is turned OFF or the mode is shifted to the power save mode. The repetition of such expansion and contraction causes repetitive rubbing between the coatings. As the result, the coatings of the adjacent electric wires 14W may be broken, and a layer short may occur. Also, when the electric wire 14W is wound, the coating may be scratched. As the electric wire 14W is used, the scratches may be opened, and a layer short may occur.

If a layer short occurs, the potentials of the two adjacent short-circuited electric wires 14W become the same. Accordingly, the number of turns of the electric wire 14W is substantially decreased, and the inductance of the coil 14 is changed. As a result, the resonance frequency of the resonant circuit 18*a* is changed.

For example, when the coil 14 originally has the inductance of 27 μH and the capacitor 17 originally has the capacitance of 0.77 μF, the resonance frequency is about 35 kHz. If a layer short occurs, the inductance is decreased. For example, if the inductance becomes 21 μH, the resonance frequency becomes about 40 kHz.

In FIG. 8, the relationship between frequency and power consumption of the magnetic-flux generation unit 18 (the power applied to the magnetic-flux generation unit 18) before the resonance frequency (the reference frequency) is changed due to a layer short is indicated by a broken line. In addition, the relationship between frequency and power consumption of the magnetic-flux generation unit 18 after the resonance frequency (the reference frequency) is changed due to a layer short is indicated by a solid line.

In the fixing device 1 according to the present embodiment, the fixing controller 9 performs feedback control so that the power consumption of the magnetic-flux generation unit 18 (the power consumption) meets the target power. If the power consumption of the magnetic-flux generation unit 18 is smaller than the target power, the fixing controller 9 decreases the switching frequency, making the switching frequency move closer to the reference frequency (the original resonance frequency). In FIG. 8, the direction in which the switching frequency is changed when the power consumption of the magnetic-flux generation unit 18 is increased is indicated by the arrow.

If a layer short occurs, however, the resonance frequency of the resonant circuit 18*a* is increased. Hence, even if the fixing controller 9 decreases the switching frequency by the feedback control, the power consumption of the magnetic-flux generation unit 18 (the power applied to the magnetic-flux generation unit 18) is not increased. In other words, if the fixing controller 9 decreases the switching frequency by the feedback control, the switching frequency moves farther from the new resonance frequency, and the power supplied to the magnetic-flux generation unit 18 is decreased.

In this instance, the fixing controller 9 can no longer properly control the switching frequency, and can no longer hold the temperature of the heat roller 11 at a temperature proper for the fixing of toner images. Hence, if printing is continued although a layer short occurs, a fixing failure may occur due to an insufficient temperature and printing with low image quality may result.

If the fixing controller 9 changes the switching frequency by the feedback control because the power applied to the magnetic-flux generation unit 18 does not meet the target power, the switching frequency may be a frequency improper for the switch unit 18*b*. Hence, the switching element of the switch unit 18*b* (in the present embodiment, the IGBT 18*c*) may be broken. If the switch unit 18*b* is broken, the heat roller 11 will no longer generate heat (no longer apply heat), and serious repair such as replacement of the fixing device 1 may be required.

Therefore, in the fixing device 1 according to the present embodiment, the fixing controller 9 detects the occurrence of a layer short depending on whether or not the difference between the switching frequency that is set in response to the instruction of the target power and the switching frequency adjusted by the feedback control (a change width) exceeds a predetermined change width. If the fixing controller 9 detects the occurrence of a layer short, the fixing controller 9 stops the switching control of the driver 19 (the power supply to the magnetic-flux generation unit 18).

Figure 9:
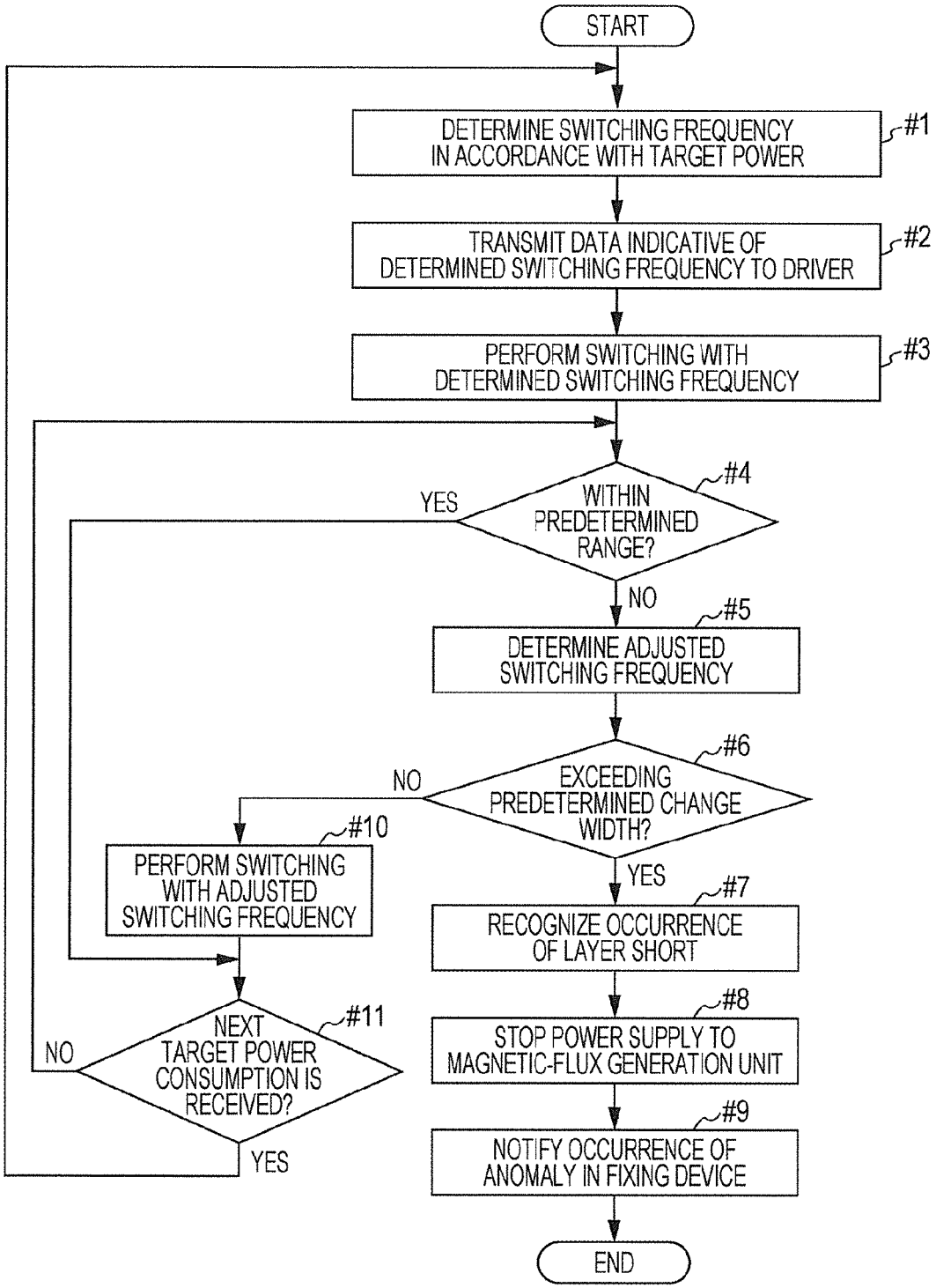
FIG. 9 is a flowchart showing the detection of the occurrence of a layer short and the stopping of heating.

Flow of the Detection for Occurrence of Layer Short and the Stopping of Heat Generation Next the detection of the occurrence of a layer short and the stopping of heat generation in the fixing device 1 according to the present embodiment is described with reference to FIG. 9. FIG. 9 is a flowchart showing the detection of the occurrence of a layer short and the stopping of heat generation.

FIG. 9 starts in the situation in which the fixing controller 9 receives the data indicative of the target power from the engine controller 80.

When the fixing controller 9 receives the data indicative of the target power from the engine controller 80, the fixing controller 9 references the stored content in the memory 92, and determines the switching frequency in accordance with the target power (step #1). Then the fixing controller 9 transmits the data indicative of the determined switching frequency to the driver 19 (step #2). In other words, the fixing controller 9 transmits the data indicative of the frequency with which switching should be done in accordance with the instructed target power to the driver 19 (step #2). In response, the driver 19 causes the switch unit 18*b* to perform switching with the determined frequency (step #3).

Then the fixing controller 9 checks whether or not the difference between the current power consumption of the magnetic-flux generation unit 18 (the power applied to the magnetic-flux generation unit 18) and the target power is within a predetermined range based on the output of the current amount detecting sensor 95 (step #4). The predetermined range is a range within which the current power consumption of the magnetic-flux generation unit 18 is considered to meet the target power, even if there is a difference (a range within which the power consumption can be considered to be equivalent to the target power). The predetermined range can be determined.

If the difference is not within the predetermined range (NO in step #4), the switching frequency that is adjusted (the adjusted switching frequency) is determined on the basis of the difference between the current power consumption of the magnetic-flux generation unit 18 and the target power (step #5). In the present embodiment, if a layer short occurs, the switching frequency is adjusted, specifically decreased.

Then the fixing controller 9 checks whether or not the difference between the adjusted switching frequency and the switching frequency determined in accordance with the target power exceeds the predetermined change width (step #6).

The predetermined change width is used to detect the occurrence of a layer short. Proper values of the predetermined change width are properly determined with regard to the characteristics of the fixing device 1, such as the magnitude of the resonance frequency, and an average amount of change in switching frequency by normal feedback control. For example, the predetermined change width may be an amount of change of the switching frequency, the amount which exceeds the change width of the switching frequency of the normal feedback control after the switching frequency of the switch unit 18*b* is set in accordance with the target power and which is recognized as abnormal.

If the difference exceeds the predetermined change width (YES in step #6), the fixing controller 9 recognizes the occurrence of a layer short (step #7). Then the fixing controller 9 instructs the driver 19 to cause the switch unit 18*b* to stop the power supply to the resonant circuit 18*a* (stop the switching of the switch unit 18*b*, step #8).

The fixing controller 9 also causes the operation panel 3 to make a notification of the occurrence of an anomaly in the fixing device 1 through the engine controller 80 and the main controller 7 (step #9). For example, the operation panel 3 causes the liquid crystal display unit 31 to display the occurrence of an anomaly in the fixing device 1 and indicate that a service person should be called. The notification method is not limited to the displaying by the liquid crystal display unit 31, and may utilize another method such as blinking of an LED provided on the operation panel 3. In this case, the operation panel 3 functions as part of the fixing device 1 (the operation panel 3 also operates as a notification unit of the fixing device 1). At this point, the flow path is ended (END). As a result, investigation and repair of the fixing device 1 can be made by a service person or the like.

If the difference is within the predetermined change width (NO in step #6), the fixing controller 9 instructs the driver 19 to cause the switch unit 18*b* to perform the switching with the adjusted switching frequency (step #10).

If the difference between the current power consumption of the magnetic-flux generation unit 18 and the target power is within the predetermined range (YES in step #4), the flow shifts to step #11 (after step #10). In step #11, the fixing controller 9 checks whether or not data indicative of the next target power is received. If the fixing controller 9 receives the data indicative of the next target power (YES in step #11), the flow path returns to step #1. In contrast, if the fixing controller 9 does not receive the data indicative of the next target power (NO in step #11), the flow path returns to step #4.

Because of a change in resonance frequency due to a layer short, even if the feedback control is performed so that the power consumption of the magnetic-flux generation unit 18 meets the target power, the power consumption of the magnetic-flux generation unit 18 may not be properly controlled. Therefore, a fixing device 1 according to the present embodiment includes a heat rotational member (a heat roller 11), a pressure rotational member (a pressure roller 12), a magnetic-flux generation unit 18, a detector (a current amount detecting sensor 95) and a fixing controller 9. The heat rotational member contacts a sheet P, on which a toner image is transferred, and fixes the toner image to the sheet P with heat. The pressure rotational member presses the heat rotational member to form a nip (a fixing nip F), applies a pressure to the sheet P, which passes through the nip, and hence fixes the toner image to the sheet P. The magnetic-flux generation unit 18 includes a resonant circuit 18*a* and a switch unit 18*b*. The resonant circuit 18*a* includes a coil 14 that generates a magnetic flux, which causes the heat rotational member to generate heat by induction heating, and a capacitor 17. The switch unit 18*b* is connected to the resonant circuit 18*a* and performs switching of power supply to the resonant circuit 18*a*. The detector is used for detecting power consumption of the magnetic-flux generation unit 18; and a fixing controller 9. The fixing controller 9 recognizes the power consumption of the magnetic-flux generation unit 18 based on an output of the detector, in response to an instruction of target power applied to the magnetic-flux generation unit 18 from the outside; sets a switching frequency of the switch unit 18*b* in accordance with the target power, if current power consumption of the magnetic-flux generation unit 18 is smaller than the target power; adjusts the switching frequency to move towards a reference frequency, which is a resonance frequency of the resonant circuit 18*a*; and further, causes the switch unit 18*b* to stop the power supply to the resonant circuit 18*a* if a difference between the switching frequency set in accordance with the target power and the adjusted switching frequency exceeds a predetermined change width.

Accordingly, the situation in which the power supply is continued to the magnetic-flux generation unit 18 under the condition in which the power consumption of the magnetic-flux generation unit 18 cannot be properly controlled can be prevented. Also, since the switch unit 18*b* is caused to stop the power supply to the resonant circuit 18*a*, the situation in which the switching frequency is changed to a frequency with which the fixing device 1 may be broken can be prevented. Hence, the switching element that turns ON and OFF the power supply to the magnetic-flux generation unit 18 (the resonant circuit 18*a*) can be prevented from being broken, and the fixing device 1 can be prevented from being broken. Also, a special circuit or sensor is not required since a layer short is detected by using the current amount detecting sensor 95 (the detector) for detecting the power consumption of the magnetic-flux generation unit 18 typically provided in a device that performs induction heating.

Further, the detector (the current amount detecting sensor 95) may output to the fixing controller 9 a signal indicative of a magnitude of input current to the magnetic-flux generation unit 18. The fixing controller 9 may change the switching frequency and hence adjust the input current so that the power consumption of the magnetic-flux generation unit 18 meets the target power. Accordingly, the power applied to the magnetic-flux generation unit 18 can meet the target power. Also, while a large current may flow through the coil 14, the current input to the magnetic-flux generation unit 18 is detected, but the current flowing through the coil 14 is not directly detected. Hence, the detector does not have to employ an expensive circuit that can handle large current. Accordingly, manufacturing cost of the fixing device 1 can be decreased.

The fixing device 1 may further include a notification unit (an operation panel 3) that notifies a user of information. When the fixing controller 9 causes the switch unit 18*b* to stop the power supply to the resonant circuit 18*a*, the fixing controller 9 may cause the notification unit to make a notification of an anomaly in the fixing device 1. Accordingly, the user can be notified that a problem occurs in the fixing device 1 and that investigation of the condition and repair are required.

Further, the fixing controller 9 may cause the switch unit 18*b* to perform the switching with a frequency higher than the reference frequency (resonance frequency). If a layer short occurs, the inductance of the resonant circuit 18*a* is decreased, and hence the resonance frequency is increased. In this case, if a layer short occurs, changing the switching frequency to move closer to the reference frequency changes the switching frequency in a direction in which the switching frequency moves farther from the changed resonance frequency. Accordingly, even if the switching frequency is adjusted after a layer short occurs, a countermeasure can be taken to prevent excessive current from flowing through the switch unit 18*b*.

In addition, the fixing device 1 may further include a temperature detector (a temperature sensor 15) for detecting a temperature of the heat rotational member (the heat roller 11) and a controller (an engine controller 80) that recognizes the temperature of the heat rotational member based on an output of the temperature detector, and gives an instruction of the target power to the fixing controller 9 in accordance with the recognized temperature. Accordingly, the fixing controller 9 controls the power consumption of the magnetic-flux generation unit 18 based on the temperature of the heat rotational member.

The present disclosure further includes an image forming apparatus (for example, a multi-functional peripheral 100) includes the above-described fixing device 1. Accordingly, the image forming apparatus, in which, if a layer short occurs in the fixing device 1, the heating operation is automatically stopped before the fixing device 1 is seriously damaged, can be provided. Thus, the image forming apparatus in which repair and maintenance of the fixing device 1 are easily performed can be provided.

The embodiment of the present disclosure has been described above; however, the scope of the disclosure is not limited to the embodiment, and may be implemented by adding various modifications within the scope not departing from the spirit of the disclosure.

What is claimed is:

1. A fixing device for use in an image forming apparatus, the fixing device comprising:

a heat rotational member configured to contact a sheet on which a toner image is transferred and to fix the toner image to the sheet;

a pressure rotational member configured to press the heat rotational member to form a nip, to apply a pressure to the sheet, which passes through the nip, and to fix the toner image to the sheet;

a magnetic-flux generation unit including a resonant circuit including a coil that generates a magnetic flux, which causes the heat rotational member to generate heat by induction heating, and a capacitor, and a switch unit that is connected to the resonant circuit and performs switching of power supply to the resonant circuit;

a detector configured to detect power consumption of the magnetic-flux generation unit; and a fixing controller configured to recognize the power consumption of the magnetic-flux generation unit based on an output of the detector in response to an instruction of a target power applied to the magnetic-flux generation unit from the outside, to set a switching frequency of the switch unit in accordance with the target power if present power consumption of the magnetic-flux generation unit is smaller than the target power, to check a difference between the present power consumption of the magnetic-flux generation unit and the target power, and move the switching frequency closer to a reference frequency until a difference between the present power consumption of the magnetic-flux generation unit and the target power is within a predetermined range by feedback control, and to cause the switch unit to stop the power supply to the resonant circuit if a difference between the switching frequency set in accordance with the target power and the adjusted switching frequency exceeds a predetermined change width during the feedback control.

2. The fixing device according to claim 1, wherein the reference frequency is a resonance frequency of the resonant circuit.

3. The fixing device according to claim 1, wherein the detector outputs a signal to the fixing controller, the signal being indicative of a magnitude of an input current to the magnetic-flux generation unit.

4. The fixing device according to claim 3, wherein the fixing controller changes the switching frequency to adjust the input current so that the power consumption of the magnetic-flux generation unit meets the target power.

5. The fixing device according to claim 1, further comprising:

a notification unit configured to notify a user of information, wherein, when the fixing controller causes the switch unit to stop the power supply to the resonant circuit, the fixing controller causes the notification unit to make a notification of an anomaly in the fixing device.

6. The fixing device according to claim 1, wherein the fixing controller causes the switch unit to perform the switching with a frequency higher than the reference frequency.

7. The fixing device according to claim 1, further comprising:

a temperature detector configured to detect a temperature of the heat rotational member.

8. The fixing device according to claim 7, further comprising:

a controller configured to recognize the temperature of the heat rotational member based on an output of the temperature detector, and to give an instruction of the target power to the fixing controller in accordance with the recognized temperature.

9. The fixing device according to claim 1, wherein the coil of the resonant circuit includes a plurality of ferrite cores positioned along the coil for preventing the magnetic flux generated by the coil from being diffused.

10. An image forming apparatus, comprising:

a transport unit configured to transport a sheet;

an image forming unit configured to form a toner image, which is transferred on the sheet; and a fixing device configured to fix the toner image, which is transferred on the sheet, to the sheet, wherein the fixing device includes a heat rotational member configured to contact the sheet on which the toner image is transferred and to fix the toner image to the sheet;

a pressure rotational member configured to press the heat rotational member to form a nip, to apply a pressure to the sheet, which passes through the nip, and to fix the toner image to the sheet;

a magnetic-flux generation unit including a resonant circuit including a coil that generates a magnetic flux, which causes the heat rotational member to generate heat by induction heating, and a capacitor, and a switch unit that is connected to the resonant circuit and performs switching of power supply to the resonant circuit;

a detector configured to detect power consumption of the magnetic-flux generation unit; and a fixing controller configured to recognize the power consumption of the magnetic-flux generation unit based on an output of the detector in response to an instruction of a target power applied to the magnetic-flux generation unit from the outside, to set a switching frequency of the switch unit in accordance with the target power if present power consumption of the magnetic-flux generation unit is smaller than the target power, to check a difference between the present power consumption of the magnetic-flux generation unit and the target power, and move the switching frequency closer to a reference frequency until a difference between the present power consumption of the magnetic-flux generation unit and the target power is within a predetermined range by feedback control, and to cause the switch unit to stop the power supply to the resonant circuit if a difference between the switching frequency set in accordance with the target power and the adjusted switching frequency exceeds a predetermined change width during the feedback control.

11. The image forming apparatus according to claim 10, wherein the reference frequency is a resonance frequency of the resonant circuit.

12. The image forming apparatus according to claim 10, wherein the detector outputs a signal to the fixing controller, the signal being indicative of a magnitude of an input current to the magnetic-flux generation unit.

13. The image forming apparatus according to claim 12, wherein the fixing controller changes the switching frequency to adjust the input current so that the power consumption of the magnetic-flux generation unit meets the target power.

14. The image forming apparatus according to claim 10, further comprising:

a notification unit configured to notify a user of information, wherein, when the fixing controller causes the switch unit to stop the power supply to the resonant circuit, the fixing controller causes the notification unit to make a notification of an anomaly in the fixing device.

15. The image forming apparatus according to claim 10, wherein the fixing controller causes the switch unit to perform the switching with a frequency higher than the reference frequency.

16. The image forming apparatus according to claim 10, further comprising:

a temperature detector configured to detect a temperature of the heat rotational member.

17. The image forming apparatus according to claim 16, further comprising:

a controller configured to recognize the temperature of the heat rotational member based on an output of the temperature detector, and to give an instruction of the target power to the fixing controller in accordance with the recognized temperature.

18. The image forming apparatus according to claim 10, wherein the coil of the resonant circuit includes a plurality of ferrite cores positioned along the coil for preventing the magnetic flux generated by the coil from being diffused.

* * * * *